United States Patent [19]

Tanimoto

[11] Patent Number: 4,644,307

[45] Date of Patent: Feb. 17, 1987

[54] CURRENT LIMITING TYPE CIRCUIT BREAKER

[75] Inventor: Akira Tanimoto, Mie, Japan

[73] Assignee: Kabushiki Kaisha Toshiba, Kawasaki, Japan

[21] Appl. No.: 839,191

[22] Filed: Mar. 13, 1986

[30] Foreign Application Priority Data

Jun. 12, 1985 [JP] Japan ..... 60-128851

[51] Int. Cl.[4] ..... H01H 77/10

[52] U.S. Cl. ..... 335/16; 335/195

[58] Field of Search ..... 335/16, 195

[56] References Cited

U.S. PATENT DOCUMENTS 3,815,059 6/1974 Spoelman ..... 335/16

FOREIGN PATENT DOCUMENTS 49-44446 12/1974 Japan .

53-45256 10/1978 Japan .

*Primary Examiner*—Harold Broome

*Attorney, Agent, or Firm*—Schwartz, Jeffery, Schwaab, Mack, Blumenthal & Evans

[57] ABSTRACT

A current limiting type circuit breaker includes first and second contact arms each pivotally mounted so as to be driven to an open position by an electromagnetic repulsive force, a trip device responsive to an output from a means for detecting a fault to drive the second contact arm to the open position, magnetic substances placed at opposite sides of the contact arms so that the magnetic resistance for magnetic fluxes occurred around the contact arms is decreased, and an attracting stationary conductor placed near the free end of the second contact arm in the open position. The attracting stationary conductor is connected in series with the first contact arm. When an excessive current flows through the contact arms, an electromagnetic attractive force is generated between the attracting stationary conductor and the second contact arm, which force increases the rate at which the second contact arm is moved to the open position.

4 Claims, 8 Drawing Figures

CURRENT LIMITING TYPE CIRCUIT BREAKER

BACKGROUND OF THE INVENTION (1) Field of the Invention

This invention relates to a current limiting type circuit breaker comprising first and second contact arms respectively carrying contacts operatable to open and close and electrical circuit and a trip mechanism responsive to an output from a means for detecting a fault such as a short-circuit or overload condition to open the contacts, and more particularly to such a device in which the contact arms are mounted for pivotal movement in the direction away from each other due to an electromagnetic repulsive force caused by an over current flowing therethrough.

(2) Description of the Prior Art

As is well known in the art, the current limiting type circuit breaker usually includes a trip mechanism which operates to open the contacts when the detecting means detects an excessively large current, and thereby opening an electrical circuit. Japanese Utility Model Publication No. 49-44446 discloses a construction in which the contact arms so provided as to become parallel to each other in the closed position is driven to open the contacts due to an electromagnetic repulsive force caused by the excessively large current flowing therethrough before operation of the trip mechanism.

According to the above-described circuit breaker, the electromagnetic repulsive force increases the speed at which the contact arm is driven so as to open the contacts. As a result, increase of an arc current can be restricted. Two types of the circuit breaker having the above-described construction are known: One is a type in which one of the contact arms is driven so as to open the contacts, and the other is a type in which both contact arms are driven when the contacts are opened. The latter type surpasses the former type in limiting current.

U.S. Pat. No. 3,815,059 discloses a circuit interrupter in which a magnetic substance is added to the latter of the above-described two types of circuit breaker so that the current limiting effect can be further improved. The magnetic substance is so placed as to provide paths for magnetic fluxes induced around the contact arms. Consequently, decrease of the magnetic resistance of the magnetic fluxes increases the electromagnetic repulsive force in magnitude.

Heightening the current limiting effect of the circuit breaker, that is, increasing the speed at which the contact arm is driven has recently desired. However, the prior art circuit breaker has a defect that the contact arm, when driven to the closed position, tends to rebound under the influence of the electromagnetic repulsive force as the driven speed thereof is increased, so that the contacts are reclosed.

SUMMARY OF THE INVENTION

It is, therefore, a primary object of this invention to provide an improved current limiting type circuit breaker in which the contact arms are driven at high speed to thereby obtain higher current limiting effect.

It is another object of this invention to provide an improved current limiting type circuit breaker in which the contact arms are effectively prevented from rebounding to the closed position upon being moved due to the electromagnetic repulsive force caused by the over current flowing therethrough, and thereby preventing occurrence of chattering between the contacts.

According to this invention, the current limiting type circuit breaker is characterized in that an attracting stationary conductor is added to the known construction comprising first and second contact arms each carrying a contact and each mounted for pivotal movement from the circuit closed position to the open position by an electromagnetic repulsive force against the force of a spring urged in the direction of the closed position, a trip mechanism responsive to an output from a means for detecting a fault such as a short-circuit or overload condition to thereby move the second contact arm to the open position at high speed, and a pair of magnetic substances which are placed so that the magnetic resistance of the magnetic fluxes induced so as to bring about the electromagnetic repulsive force around each contact arm is decreased.

The attracting stationary conductor is placed so that the free end of the second contact arm is positioned near it in the open position but does not abut against it. The attracting stationary conductor includes an operative portion extending in the elongated direction of the second contact arm. The attracting stationary conductor is connected in series with the first contact arm so that the current flows in the same direction as that of the electromagnetic attractive force induced between the operative portion thereof and the second contact arm.

When a load current exceeding a predetermined value flows in series through the first and second contact arms and the attracting stationary conductor, the second contact arm suffers the electromagnetic attractive force from the operative portion of the attracting stationary conductor as well as the electromagnetic repulsive force from the first contact arm. Consequently, the second contact arm is driven to the open position at high speed, and thereby obtaining high current limiting effect. Further the electromagnetic attractive force effectively prevents the second contact arm from rebounding to the closed position, and thereby preventing the contacts from chattering therebetween.

Other and further objects of this invention will become obvious upon an understanding of the illustrative embodiment about to be described or will be indicated in the appended claims, and various advantages not referred to herein will occur to one skilled in the art upon employment of the invention in practice.

DETAILED DESCRIPTION OF A PREFERRED EMBODIMENT

Figure 1:
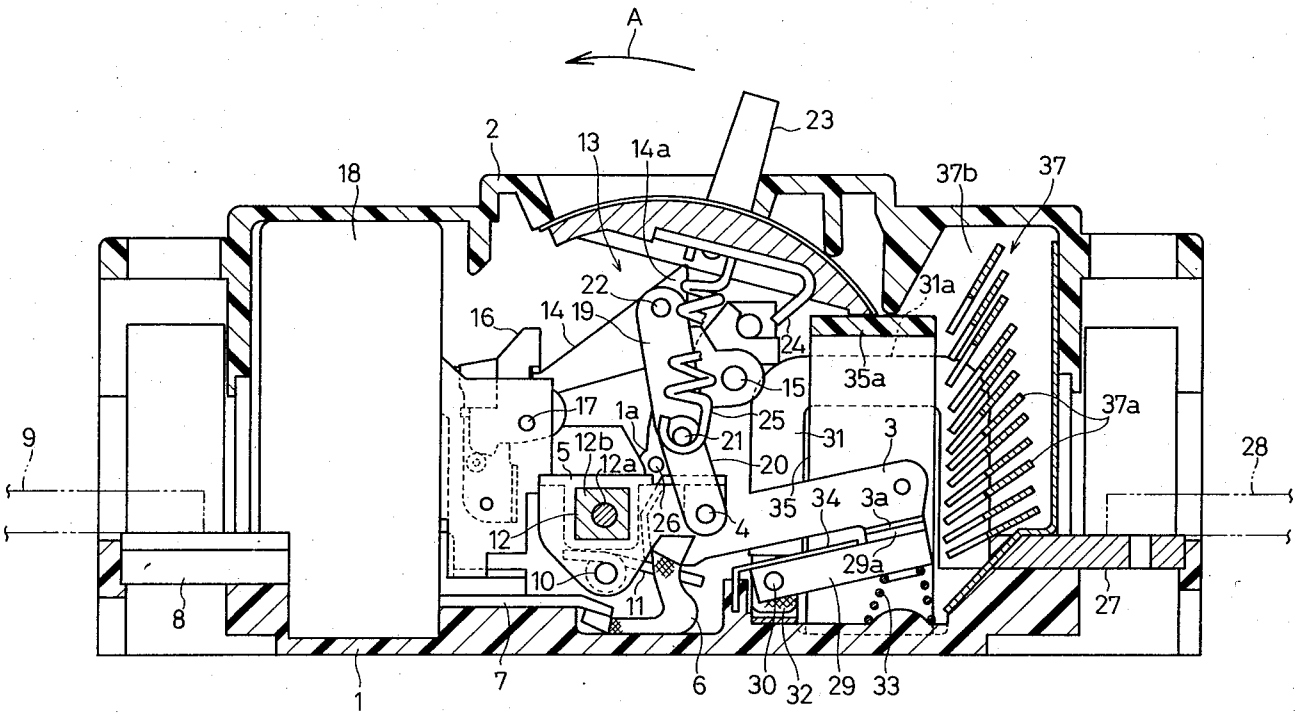
FIG. 1 is a longitudinal view of one embodiment of a current limiting type circuit breaker of this invention, a pair of contact arms being in the closed position.

Referring to FIG. 1 of the drawings, a molded insulating case 1 and an insulating cover 2 form a box which encloses a circuit breaking structure hereinafter described. A second contact arm 3 has a contact 3*a* fixed to a free end thereof. The second contact arm 3 is mounted on a contact arm holder 5 for pivotal movement about a pin 4 and connected at the supported end to a terminal plate 8 for connecting it to a load through a flexible conductor 6 and an intermediary conductor 7 therebetween. A conductor 9 of an external circuit is connected to the terminal plate 8. The holder 5 is provided with a pin 10 on which a torsion spring 11 is mounted to apply contact pressure to the second contact arm 3. The number of the second contact arm 3, the holder 5, the flexible conductor 6, the intermediary conductor 7 and the terminal plate 8 depends upon the number of poles.

The holder 5 is supported by a cross bar 12 extending therethrough for pivotal movement about the cross bar 12. The cross bar 12 is comprised of a mandrel 12*a* and an insulator 12*b* covering the mandrel 12*a*.

A trip mechanism 13 includes a catch 14 supported by a supporting frame 1*a* for pivotal movement about a pin 15. One end of the catch 14 is adapted to be latched by a latch 16. The latch 16 is mounted on a pin 17 and adapted to release the catch 14 upon receipt of an output or mechanical displacement from a means for detecting a fault such as an over current or short-circuit current. The detecting means 18 is an electromagnetic, thermal or other type well-known to one skilled in the art.

Figure 3:
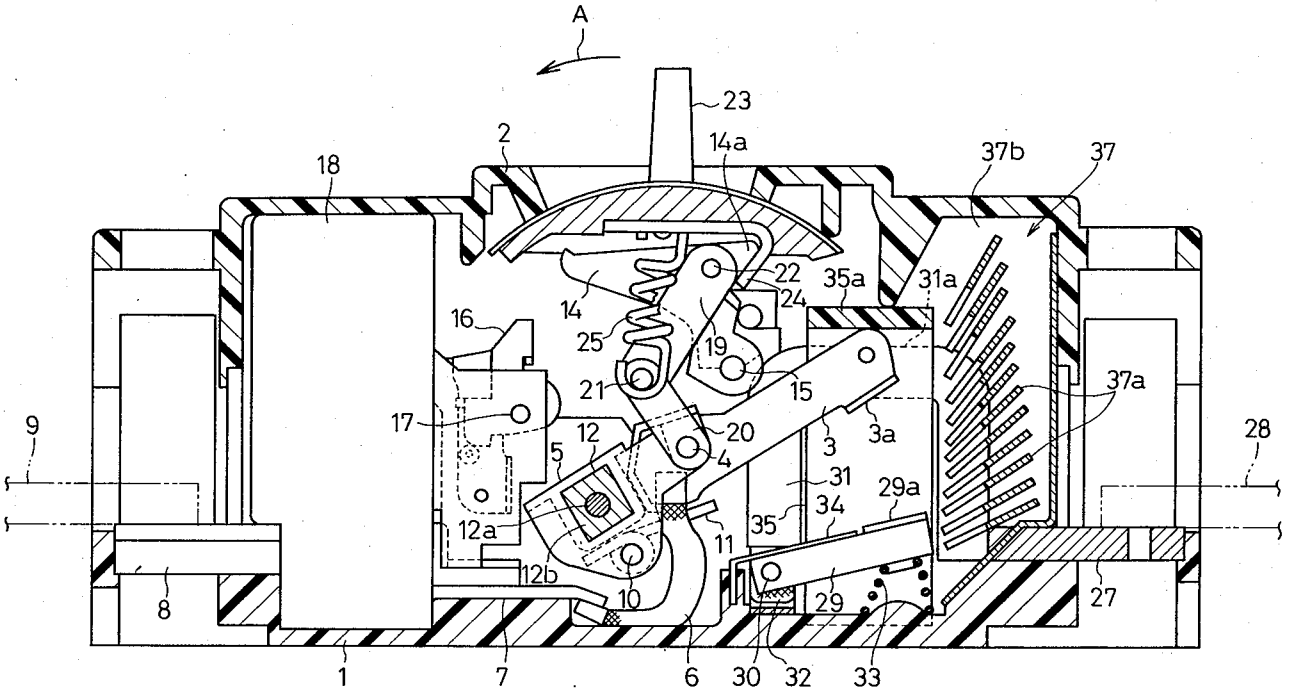
FIG. 3 is also a view similar to FIG. 1 in a condition where tripping operation of the trip mechanism has been completed.

The upper end of an upper link 19 is connected to the catch 14 by a pin 22 for rotatable movement. The lower end of a lower link 20 is connected to the pin 4 for rotatable movement. An external handle 23 having a strip 24 at the underside is connected to the supporting frame 1*a* by a pin 26, which is schematically shown in the drawings. The strip 24 operates to engage the catch 14 with the latch 16 by pushing a portion 14*a* so that the catch 14 is latched when the handle 23 is moved in the direction of arrow A in the state of condition where the circuit breaker is tripped as shown in FIG. 3. An extension spring 25 is provided between the handle 23 and an intermediary pin 21.

A first contact arm 29 is provided between the second contact arm 3 and the bottom of the case 1 and opposed to the contact arm 3 in the elongated direction thereof. One end of the first contact arm 29 is supported by the supporting frame 1*a* for pivotal movement about a pin 30. The other end is provided with a contact 29*a* which is cooperable with the contact 3*a* secured to the second contact arm 3. The free end of the first contact arm 29 is received at the opposite side of the contact 29*a* by a compression spring 33 secured to the underside of the case 1. The movement of the first contact arm 29 toward the second contact arm 3 by the force of a compression spring 33 is limited by a stop 34 fixedly mounted on the case 1.

Figure 2:
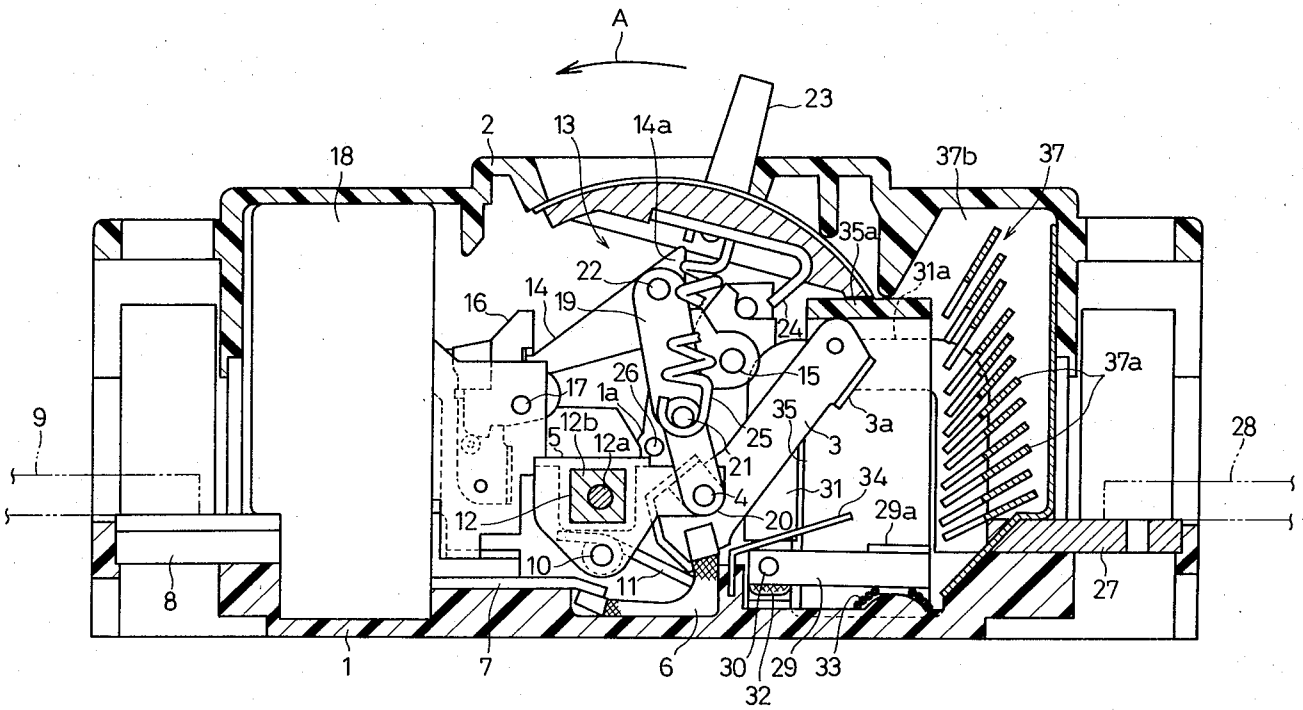
FIG. 2 is a view similar to FIG. 1 in a condition immediately before the occurrence of tripping operation of the trip mechanism with the contact arms driven to the respective open positions.
Figure 4:
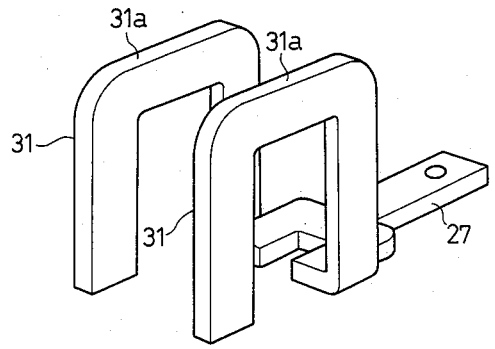
FIG. 4 is a perspective view of the attracting stationary conductors provided in the device shown in FIG. 1.

Inverted generally U-shaped attracting stationary conductors 31 for obtaining an electromagnetic attractive force between the second contact arm 3 and them are spaced from each other in parallel as shown in FIG. 4. Each one end of the attracting stationary conductors 31 is integrally connected with a terminal plate 27 for connection to a power source to be connected to a power source line conductor 28. Each other end is connected with the supported end of the first contact arm 29 in common through a flexible conductor 32. Each operative portion 31*a* of the attracting stationary conductors 31 is adjacent to the plane along which the contact arms 29 and 3 are driven and spaced from the first contact arm 29 in the direction of movement of the second contact arm 3 to the open position. Each operative portion 31*a* extends in the elongated direction of the second contact arm 3. In this embodiment, particularly, the operative portions 31*a* of the attracting stationary conductors 31 are adjacent to the free end of the second contact arm 3 in the open position in the lateral direction as shown in FIG. 2 but do not abut against it.

A pair of magnetic substances 35 are so placed as to be opposite to the plane along which the contact arms 29 and 3 are driven, with the operative portions 31*a* located therebetween. The magnetic substances 35 are connected with each other by a molded plastic member 36 so that they they are of an inverted U-shape. The bottom portions 35*a* (upper side throughout the FIGURES) of the inverted U-shaped magnetic substances 35 serve as a stop for the second contact arm 3.

A well-known arc-extinguishing means 37 comprised of deionizing grids 37*a* and a supporting frame 37*b* is provided in the case 1. Arc is drawn out between the contacts 3*a* and 29*a* and rapidly extinguished by the electromagnetic force.

The operation of the current limiting type circuit breaker of this invention will be hereinafter described.

When the contacts 3*a* and 29*a* are manually opened in the closed condition shown in FIG. 1, the handle 23 is moved in the direction of arrow A in FIG. 1. Movement of the handle 23 moves the tension spring 25 in the same direction as that of the handle 23. When the center line of the tension spring 25 passes a line linking the pin 22 with the intermediary pin 21 in the direction of arrow A, the pin 21 is rapidly moved by the force of the tension spring 25 in the elongated direction of the tension spring 25. The holder 5 and the second contact arm 3 are driven about the cross bar 12 in the counterclockwise direction, and thereby opening the contacts 3*a* and 29*a*. This state of condition is kept by the force of the tension spring 25. The contacts 3*a* and 29*a* are manually closed by movement of the handle 23 in the direction opposite to arrow A.

When an overload current or a relatively large current due to short-circuit flows continuously for more than a predetermined period of time in the closed condition shown in FIG. 1, the detecting means 18 detects the current to thereby drive the latch 16 in the counterclockwise direction so that the catch 14 is released. The catch 14 is rapidly moved by the force of the tension spring 25 in the clockwise direction as shown in FIG. 3. The lower link 20 is lifted upwardly in response to movement of the catch 14. The second contact arm 3 is driven upwardly about the cross bar 12 together with the holder 5, and thereby opening the contacts 3*a* and 29*a*. The handle 23 is stopped at the middle position as shown in FIG. 3 when the above-described tripping operation is completed. In the state of condition shown in FIG. 3, the handle 23 is moved in the direction of arrow A from the middle position. The catch 14 is pushed in the counterclockwise direction by the strip 22 mounted on the underside of the handle 23 and latched by the latch 16. Afterwards, the contacts are closed by movement of the handle 23 in the direction opposite to arrow A. The above-described operation is the same as that of the well-known automatic trip type circuit breaker and the description will not go further.

Figure 5:
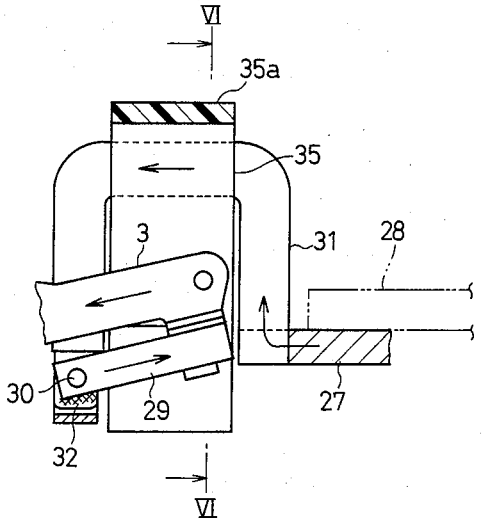
FIG. 5 is a partial sectional view taken along a line V—V in FIG. 6.
Figure 6:
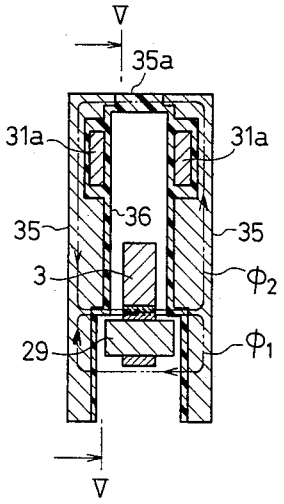
FIG. 6 is also a partial sectional view taken along a line VI—VI in FIG. 5.
Figure 7:
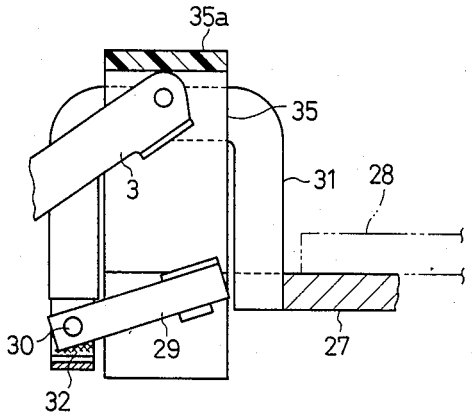
FIGS. 7 and 8 are similar to FIGS. 5 and 6 respectively wherein the contact arms are in the respective open positions.
Figure 8:
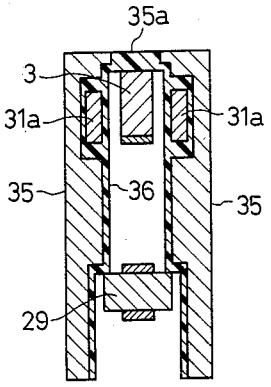

In the occurrence of a short-circuit current larger than an overload current in the state of condition shown in FIG. 1, the current flows through the attracting stationary conductors 31, the first contact arm 29 and the second contact arm 3 in the direction of arrows shown in FIG. 5. In this case, the direction in which the current flows through the second contact arm 3 is opposite to that of the current flowing through the first contact arm 29, so that an electromagnetic repulsive force is induced between the contact arms 3 and 29. An electromagnetic repulsive force is also induced between each operative portion 31*a* of the attracting stationary conductors 31 and the first contact arm 29. The current flows in the same direction through each operative portion 31*a* and the second contact arm 3 so that an electromagnetic attractive force is induced therebetween. The second contact arm 3 is driven in the counterclockwise direction at high speed against the force of the torsion spring 11 by the electromagnetic repulsive and attractive forces. Simultaneously, the first contact arm 29 is driven in the clockwise direction against the force of the compression spring 33, and thereby opening the contacts 3*a* and 29*a*. The above-described operation of opening the contacts 3*a* and 29*a* by the electromagnetic forces starts together with the trip operation to release the catch 14 from the latch 16. Consequently, the rate at which the contacts 3*a* and 29*a* are opened is increased and the rate at which an arc voltage, that is, an arc resistance between the contacts 3*a* and 29*a* rises is increased, and thereby decreasing an arc current. In the above-described current limiting operation, a magnetic flux $\phi_1$ occurred around the first contact arm 29 and a magnetic flux $\phi_2$ occurred around each operative portion 31*a* of the attracting stationary conductors 31 and the second contact arm 3 pass through a pair of magnetic substances 35. As a result, the magnetic resistace in each path of the magnetic fluxes $\phi_1$ and $\phi_2$ is decreased by each magnetic substance 35 and both electromagnetic repulsive and attractive forces are increased. Consequently, the rate at which the contact arms 3 and 29 are driven to the respective open positions, in other words, the rate at which the contacts 3*a* and 29*a* are opened is increased, and thereby providing still high current limiting effect. Further, the movement of the second contact arm 3 in the direction of the open position is limited by the underside portions of the magnetic substances 35 as stop as shown in FIGS. 7 and 8. The free end of the second contact arm 3 comes closest to each operative portion 31*a* of the attracting stationary conductors 31 at the position where its movement is limited. The electromagnetic attractive force is relatively large magnitude is generated between the free end of the second contact arm 3 and each attracting stationary conductor 31. Consequently, the second contact arm 3, upon which the reaction force acts when driven in the counterclockwise direction at high speed, is prevented from rebounding toward the closed position. Two attracting stationary conductors are provided for one second contact arm 3 in the above-described embodiment, but one attracting stationary conductor may be provided.

According to the current limiting type circuit breaker of this invention, the rate at which the second contact arm 3 is driven in the direction of the open position is increased by the electromagnetic repulsive force induced between it and the first contact arm 29 and the electromagnetic attractive force induced between it and the attracting stationary conductor. The movement of the contact arm 3 in the direction of the open position is further accelerated by employing unique arrangement of the magnetic substances which decrease the electromagnetic resistance in the paths of the magnetic fluxes creating the electromagnetic repulsive and attractive forces, thereby providing effective current limiting action. Further, the second contact arm 3 is prevented from rebounding and chattering by the electromagnetic force created between each attracting stationary conductor 31 and the second contact arm 3 when the electromagnetic force created between the first and second contact arms 29 and 3 moves the second contact arm 3 in the direction of the open position at high speed, thereby denecessitating a specific mechanism to prevent rebound of the contact arm and providing a circuit breaker of simple construction.

What is claimed is:

1. In a current limiting type circuit breaker including:

(a) a first contact arm supported at one end for pivotal movement and having a contact secured to a free end thereof;

(b) a second contact arm supported at one end for pivotal movement so as to be placed opposite to said first contact arm in the elongated direction thereof and having a contact secured to a free end thereof so that it cooperates with said contact secured to the free end of said first contact arm, said first and second contact arms being normally urged by suitable spring means in the direction of the closed position, said first and second contact arms being pivotally moved by an electromagnetic repulsive force induced by an over current flowing therethrough;

(c) magnetic substances placed in proximity to the lateral sides of said first and second contact arms so as to be substantially parallel with a plane along which said contact arms are moved, whereby magnetic fluxes induced around said contact arms by the over current pass through said magnetic substances; and (d) a trip mechanism responsive to an output from a means for detecting abnormal current such as an over current flowing through said contact arms to thereby drive the second contact arm so that the contacts are opened, the improvement comprising:

an attracting stationary conductor disposed between each of said magnetic substances and the plane along which said first and second contact arms are driven and spaced from the first contact arm in the direction of movement of the second contact arm to the open position, said attracting stationary conductor having an operative portion extending in the elongated direction of the second contact arm, said attracting stationary conductor being connected in series with the first contact arm so that the current flows in the same direction through said operative portion thereof and the second contact arm, thereby providing an electromagnetic attractive force therebetween.

2. A current limiting type circuit breaker as set forth in claim 1, wherein said attracting stationary conductor is placed so that the operative portion thereof is adjacent to the free end of the second contact arm at the open position in the lateral direction.

3. A current limiting type circuit breaker as set forth in claim 1, wherein said magnetic substances are placed at respective sides of the plane along which said contact arms are driven and wherein said attracting stationary conductor has two divided operative portions each of which is placed at opposite sides of the second contact arm.

4. A current limiting type circuit breaker as set forth in claim 1, wherein said attracting stationary conductor has a member for connecting it to an external circuit and a substantially U-shaped portion which includes the operative portion at the bottom thereof, one end of said U-shaped portion being connected with the supported end of the first contact arm, the other end thereof being placed in proximity to the free end of the first contact arm, said connecting member being integrally extended from the other end of the U-shaped portion of the attracting stationary conductor.

* * * * *